United States Patent [19]

Sullivan et al.

[11] Patent Number: 4,865,200

[45] Date of Patent: Sep. 12, 1989

[54] SHIPPING CONTAINER FOR FRAGILE ITEMS

[76] Inventors: Gordon R. Sullivan; Dawn M. Sullivan, both of P.O. Box 2736, Great Falls, Mont. 59403

[21] Appl. No.: 297,140

[22] Filed: Jan. 13, 1989

[51] Int. Cl.[4] ..... B65D 81/02

[52] U.S. Cl. ..... 206/583; 206/449; 206/451; 206/521; 206/585; 206/594

[58] Field of Search ..... 206/335, 317, 521, 449, 206/451, 482, 499, 585, 593, 594, 453, 425, 424, 582, 583, 586

[56] References Cited

U.S. PATENT DOCUMENTS

| | | | |
|---|---|---|---|
| 1,456,098 | 5/1923 | Doane | 206/593 |
| 1,676,238 | 7/1928 | Batty | 206/449 |
| 2,005,967 | 6/1935 | Berdan | 206/454 |
| 2,281,657 | 5/1942 | Aquino | 206/454 |
| 2,827,219 | 3/1958 | Sparks | 206/592 |
| 3,182,885 | 5/1965 | Maio | 206/592 |
| 3,227,356 | 1/1966 | Eifrid | 206/424 |
| 3,356,209 | 12/1967 | Pezely, Jr. | 206/594 |
| 3,596,830 | 8/1971 | McFarland | 206/592 |
| 3,854,650 | 12/1974 | Hanaue | 206/586 |
| 4,360,145 | 11/1982 | Wilcox | 206/586 |
| 4,432,454 | 2/1984 | Bloom | 206/449 |
| 4,792,043 | 12/1988 | Holladay | 206/594 |

FOREIGN PATENT DOCUMENTS

| | | | |
|---|---|---|---|
| 2311729 | 12/1976 | France | 206/424 |
| 2505301 | 11/1982 | France | 206/335 |

*Primary Examiner*—David T. Fidei

*Attorney, Agent, or Firm*—Seed and Berry

[57] ABSTRACT

There is provided a shipping container for transporting fragile items. The shipping container consists of a support member and a carton dimensioned to permit insertion of the support member. The support member has a surface face to which the fragile article is suspendedly attached by flaps folded around the article and by straps. The corner side walls are of a width greater than the thickness of the article and flaps when fixed to the surface face of the support member. The gap between the flaps folded over the article and the inside wall of the carton permits limited movement of the article during shipment.

9 Claims, 3 Drawing Sheets

SHIPPING CONTAINER FOR FRAGILE ITEMS

FIELD OF THE INVENTION

The present invention relates to shipping containers in general, and more particularly to shipping containers suitable for transporting fragile flat items, such as fine art paintings.

BACKGROUND OF THE INVENTION

Fragile flat articles, such as framed art, mirrors or the like, are often required to be shipped to a distant location. Due to vibration, shock and general rough treatment of these shipped packages during commonly used truck transportation, the fragile article contained in the package may often be broken or damaged during shipment. While a variety of packaging containers have been both suggested and used for protecting fragile flat articles during shipment, none have proved entirely satisfactory.

Attempts have previously been made to immobilize and cushion an article being shipped in order to prevent damage. For example, in U.S. Pat. No. 2,281,657 a package is taught wherein flat articles are protected against abrasion by being so firmly held within the package that no rubbing can take place. Similarly, U.S. Pat. No. 2,005,967 discloses a package wherein the article to be shipped is immobilized and cushioned by use of corrugated paperboard and filler material, and U.S. Pat. No. 3,356,209 teaches the use of foam plastic to immobilize and cushion the article. Moreover, preformed rigid foam cushioning corner frames have been used to hold flat fragile articles, however, the large variety of article sizes and shapes has made these preformed frames impracticable.

While the prior packaging containers have achieved limited success, a major shortcoming remains their lack of versatility for packaging large varieties of articles, and the inadequate protection they provide against damage, particularly vibrational damage, caused by shipment. Thus, there is a need in the art for a shipping package which will permit the shipping of flat fragile items, without the damage normally associated with the present containers.

DISCLOSURE OF THE INVENTION

Accordingly, it is an object of this invention to provide a container which will permit the shipping, storage and handling of flat fragile articles without damage thereto.

An additional object of the present invention is to provide a shipping container which is inexpensive and simple to assemble, yet capable of providing protection to fragile flat articles of varying dimensions.

It is another object of this invention to provide a packaging container suitable for shipping a number of fragile flat articles which, after the container arrives at the destination, may be broken down into smaller units for further shipment or transportation.

Briefly stated, the present invention discloses a shipping container comprising a support member and a carton dimensioned to permit insertion of the support member. The support member has a surface face upon which a fragile flat article is fixed, preferably by adjustable flaps folded over and secured around the article. The support member contains corner side walls of a width greater than the thickness of the article when fixed upon the surface face of the support member. Due to the width of the corner side walls of the support member, the article is suspended and thus permitted restrained movement within the carton and prevents damage during shipment.

In another embodiment of the present invention, the container is dimensioned to permit the insertion of two support members, each support member having fixed to the surface face a fragile flat article, and each support member having corner side walls of a width greater than the thickness of the article when fixed upon the surface face of the support member. For shipping multiple containers, the containers each with a support member and art attached, are placed into a larger additional container which is then shipped to the retailer or distributor. The retailer or distributor then removes the individual shipping containers from the larger container. The retailer or distributor can then use the individual shipping container for shipping the art to its customers.

DETAILED DESCRIPTION OF THE INVENTION

Figure 1:
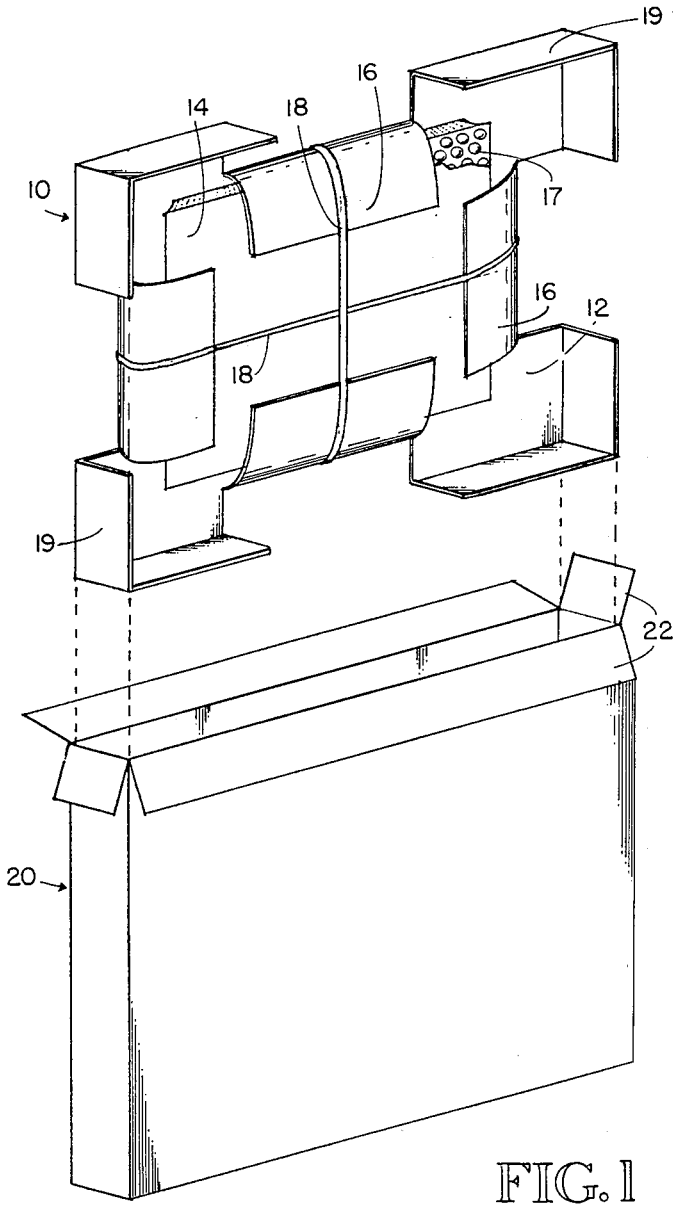
FIG. 1 is a perspective view of an embodiment of the present invention having a single article fixed to the surface face of a support member prior to insertion int a shipping carton.

The shipping container of the present invention comprises a support member and a carton dimensioned to permit insertion of the support member. Referring to Fig. 1, support member 10 has a surface face 12 to which the fragile flat article 14 is secured. Flaps 16 are folded over the fragile article, and straps 18 are used to securely fix the article to the surface face of the support member. Support member 10 is then inserted into carton 20, and the carton is closed by appropriately folding tabs 22.

Corner side walls 19 extend from the surface wall 12 of support member 10. The width of the corner side walls are greater than the thickness of the article 14 when fixed to the surface face 12 with the flaps 16 folded over and secured against the article. The side walls, by having a width greater than the width of the article when fixed to the surface face, provides for a space or gap between the inside wall of the carton opposite the article and the article itself. This space allows for restrained movement of the article along both an axis perpendicular to the surface face of the support member and in the plane of the support member, and provides protection to the article and prevents damage in the course of shipping. In addition, the corner side walls 19 provide further structural support to the carton.

While a variety of fragile articles may be transported via the shipping container of the present invention, fragile materials in the form of sheets are particularly suitable. For example, etched glass, storm doors, windows, and pieces of art may be shipped by the container of this invention. Moreover, articles of varying dimensions may be shipped by use of a support member of only one size.

As is apparent from FIG. 1, the dimensions of the surface face of the support member will dictate the maximum length and height of the article that may be fixed to the support member, however a large variety of sizes and shapes can be accommodated. If, for example, the surface face of the support member was three feet by four feet, the support member could accommodate many different size articles within the length and height of the container. It is desirable to utilize a support member with dimensions at least several inches greater than the article to be shipped to provide protection from damage caused by crushing forces against the carton.

Similarly, the width of the corner side walls of the support member provides for a variety of article widths. For example, if the width of the corner side walls is six inches, the support member could accommodate articles of varying thickness so long as their combined thickness were substantially less than six inches. Alternatively, more than one article may be fixed to the surface face of the support member provided the combined thickness of the articles is well less than six inches. Preferably, the gap or space between the article fixed to the surface face of the support member and the inside carton wall opposite the article is at least one inch to allow sufficient movement of the article during shipment.

To provide protection against scratches to the article, a layer of protecting wrap may be wrapped around the article prior to being fixed to the surface face of the support member. For example, plastic bubble wrap 17 has been found to be particularly effective in preventing scratches to the article being shipped.

Once support member 10 containing fragile article 14 is inserted into carton 20, the carton may then be sealed by tape, or other suitable means, to provide a relatively watertight and airtight shipping container. While the carton need only be dimensioned to allow insertion of the support member, a relatively tight fit is desirable to prevent movement of the support member itself. In other words, the inside dimensions of the carton should be only slightly in excess of the overall length, height and width of the support member.

It is readily appreciated that once the support member is inserted into the carton, the fragile article is capable of restrained movement along an axis perpendicular to the surface face of the support member and in the plane of the support member. Such movement will, of course, be dependent upon the rigidity of the material used to construct the support member. It is also appreciated that the shipping container of the present invention protects the article from crushing forces by removing the article from close proximity to the carton side walls.

The suspension of the article by the folded flaps and straps and the articles, spacing from the ends and sidewalls of the container, greatly enhance the elasticity of the suspension. This thus allows the article to shift or move slightly within the carton during vibration or shocks, rather than to tightly confine the article against movement. The availability of some restrained movement advantageously provides good shock and vibration protection.

Since articles are often shipped by way of parcel delivery companies, the size and strength of the shipping container frequently must meet specific carrier and insurance requirements. Thus, the shipping container of the present invention may be dimensioned to comply with size requirements, and constructed from suitable materials to comply with strength requirements. For example, corrugated cardboard having approximately a 275 psi test strength provides a suitable material for construction of both the support member and the carton.

Figure 2:
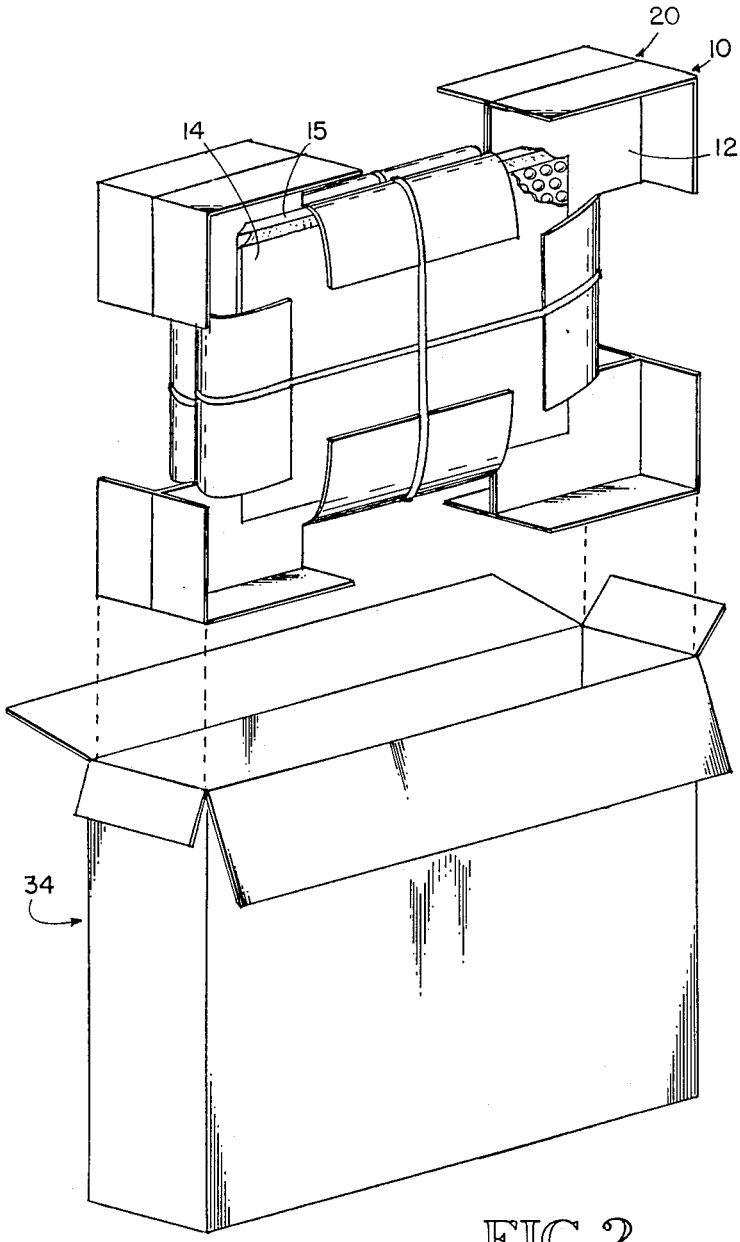
FIG. 2 is a perspective view of an alternative embodiment of the present invention depicting two support members, which have two articles fixed to the surface face, prior to insertion into a shipping carton.

Referring to FIG. 2, an alternative embodiment of the present invention is depicted in which two support members (i.e., support member 10 and support member 20) are inserted into a single carton 34. The combined support members 10 and 20 each have two articles (i.e., article 14 and article 15) fixed to their opposite surface faces. While FIG. 2 depicts the support members positioned back-to-back, they may be positioned such that the surface faces of each support member oppose each other.

The shipping container depicted in FIG. 2 has the advantage of allowing a number of fragile articles to be shipped to a destination in a single carton. Upon their arrival, the individual support members, with the articles fixed to their surface face, may be removed from carton 34 and inserted into carton 20 as depicted in FIG. 1. A single support member may then be further transported without damage to the articles fixed thereto.

Figure 3:
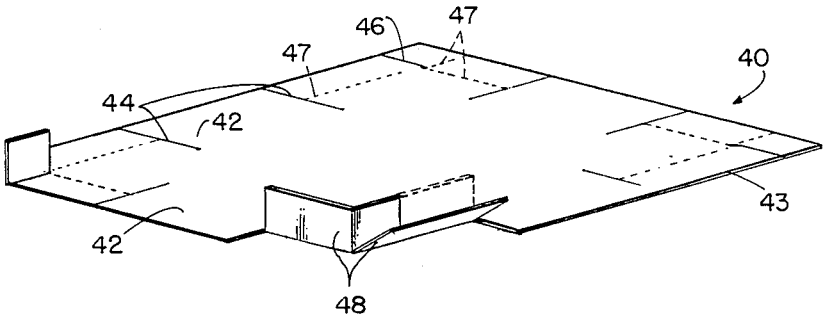
FIG. 3 is a perspective view of an embodiment of a sheet capable of foldably forming the support member of the present invention depicting the intermediate folding of the corner side walls.

Referring to FIG. 3, rectangular sheet 40, capable of foldably forming the support member of the present invention, is depicted. Sheet 40 has flap 42 along each edge wall 43 of sheet 40. The flaps are defined by a pair of incisions 44 extending inwardly from the edge wall of the rectangular sheet. A corner incision 46 is made in the sheet and scored fold lines 47 are position to foldably allow the formation of corner side walls 48. From an examination of FIG. 3, it is apparent that the length of corner incision 46, and the placement of scored fold lines 47, defines the width of corner side walls 48.

Figure 4:
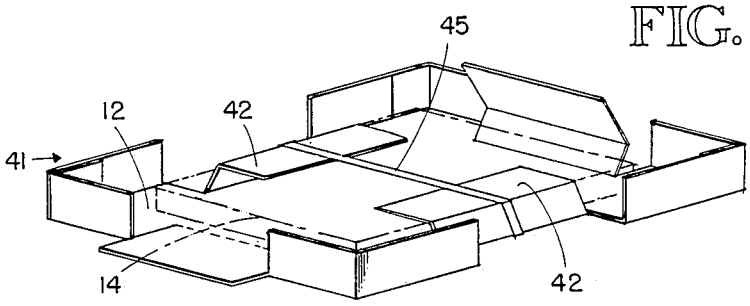
FIG. 4 is a perspective view of the sheet of FIG. 3 after the corner wide walls have been folded to form the support member, and depicting the flaps being adjustably folded over an article and fixed to the surface of the support member by use of a strap.

FIG. 4 depicts support member 41 foldably formed from sheet 40 of FIG. 1. After article 14 is placed upon the surface face 12 of support member 41, flaps 42 are folded over the article. The length of the fold is determined by the dimensions of the article. The article is then securely fixed to the surface face of the support member by a strap 45 that encircles the of the support member by a strap 45 that encircles the support member and holds the article within the confines of opposing flaps.

While sheet 40 of FIG. 3 is foldably formed into support member 41 of FIG. 4, it should be recognized that a variety of alternative incisions and fold lines may be employed to combine a variety of sizes and shapes.

While particular embodiments of this invention have been shown and described, this invention is not limited to them unless the limitation is necessary due of the prior art or spirit of the appended claims. Modifications which fall within the true spirit and the principles disclosed in this description are meant to be included to the extent possible.

We claim:

1. A shipping container for a fragile flat article comprising:

a support member having a surface face to which the article may be suspendedly fixed, flaps on the support member for suspendedly fixing the article to the surface face, and corner portions extending from the surface face a distance greater than the combined width of the article and flaps when the article is fixed to the surface face of the support member; and a carton dimensioned to allow snug reception of the corner portions of the support member and to provide an air space between the container and flaps which suspendedly fix the article to the surface face of the support member.

2. The shipping container of claim 1 wherein the flaps are defined by incisions in the surface face and being foldable over the article when the article is positioned upon the surface face of the support member, and a strap to secure the flaps against the article.

3. The shipping container of claim 1 wherein both the support member and the carton are made from corrugated cardboard.

4. A shipping container for fragile articles comprising:

a first support member having a surface face to which a first article may be suspendedly fixed, flaps on the support member for suspendedly fixing the article to the surface face, and corner portions extending from the surface face a distance greater than the combined width of the article and flaps when the article is fixed to the surface face of the support member;

a second support member having a surface face to which a second article may be suspendedly fixed, flaps on the second support member for suspendedly fixing the article to the surface face, and corner portions extending from the surface face a distance greater than the combined width of the article and flaps when the article is fixed to the surface face of the support member; and a carton dimensioned to allow insertion of the first and second support members with the corner portions snugly confined in the container and to provide an air space between the container and flaps which suspendedly fix the articles to the surface face of the first and second support members.

5. The shipping container of claim 4 wherein the flaps are defined by incisions in the surface face of each support member, said flaps being foldable over the article when the article is positioned upon the surface face of the support member, and a strap to secure the flaps of each support member against the article.

6. The shipping container of claim 4 wherein the first support member, second support member, and carton are made from corrugated cardboard.

7. A support member for a fragile article transported in a shipping carton, comprising:

a rectangular sheet having front, back, and edge walls, sheet having a plurality of independently foldable flaps defined by incisions extending inwardly from the edge walls, the flaps being foldable over the article when the article is positioned upon the front wall of the sheet, and the rectangular sheet having a corner incision and a series of scored lines to foldably permit the formation of corner side walls, the corner side walls being of a width greater than the thickness of the article and flaps when the article is suspendedly fixed to the front wall of the sheet.

8. The support member of claim 7 wherein each edge of the sheet contains one foldable flap.

9. The support member of claim 7 wherein the sheet is corrugated cardboard.

* * * * *